US007942266B2

(12) United States Patent
Weissbrod

(10) Patent No.: US 7,942,266 B2
(45) Date of Patent: May 17, 2011

(54) ELECTRODE PACKAGING TO REDUCE HANDLING DAMAGE

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 49 days.

(21) Appl. No.: 12/416,325

(22) Filed: Apr. 1, 2009

(65) Prior Publication Data

US 2010/0251672 A1 Oct. 7, 2010

(51) Int. Cl.
*B65D 85/20* (2006.01)

(52) U.S. Cl. ..... 206/443; 206/270; 220/8

(58) Field of Classification Search ..... 206/443, 206/391, 395, 407, 410, 270; 229/125.125, 229/125.12, 103.2, 4.5; 220/8
See application file for complete search history.

(56) References Cited

U.S. PATENT DOCUMENTS

| | | | | |
|---|---|---|---|---|
| 2,001,478 | A * | 5/1935 | Vogt | 426/108 |
| 2,962,187 | A * | 11/1960 | Morris | 220/780 |
| 3,037,620 | A | 6/1962 | Douty | |
| 3,642,124 | A * | 2/1972 | Brown et al. | 206/443 |
| 3,731,792 | A * | 5/1973 | Rolston | 206/389 |
| 3,848,739 | A * | 11/1974 | Fagan | 206/443 |
| 4,497,407 | A | 2/1985 | Stager | |
| 4,589,550 | A | 5/1986 | Stager | |
| 4,850,482 | A | 7/1989 | Campbell | |
| 4,976,374 | A * | 12/1990 | Macaluso | 229/122.26 |
| 5,152,737 | A | 10/1992 | Wu et al. | |
| 5,266,772 | A | 11/1993 | Reed | |
| 5,314,062 | A | 5/1994 | Wu et al. | |
| 5,328,031 | A * | 7/1994 | Hendriks | 206/443 |
| 5,403,740 | A * | 4/1995 | Menefee et al. | 435/290.1 |
| 5,680,949 | A * | 10/1997 | Roesler | 220/8 |
| 6,276,528 | B1 * | 8/2001 | Nowotny et al. | 206/397 |
| 6,915,946 | B2 | 7/2005 | Gosis et al. | |
| 2004/0173613 | A1 * | 9/2004 | Schroeder et al. | 220/276 |
| 2007/0051650 | A1 | 3/2007 | Carlozzi et al. | |
| 2009/0108008 | A1 * | 4/2009 | Weissbrod et al. | 220/669 |

FOREIGN PATENT DOCUMENTS

| | | |
|---|---|---|
| GB | 1067216 | 5/1967 |

* cited by examiner

*Primary Examiner* — David T Fidei
(74) *Attorney, Agent, or Firm* — Calfee, Halter & Griswold LLP

(57) ABSTRACT

Package for electrode rods includes a container for holding a plurality of rods, an insert for the container, the insert having a first section that fits into the container and generally conforms to an internal shape of the container, and a second section that generally conforms to a bundled shape of a plurality of the rods, with a binding that applies tension about the insert second section. In one embodiment the insert may be made of corrugated board.

19 Claims, 4 Drawing Sheets

ELECTRODE PACKAGING TO REDUCE HANDLING DAMAGE

TECHNICAL FIELD OF THE INVENTIONS

The present disclosure relates to handling of electrodes used with manual welding equipment. More particularly, the disclosure relates to packaging apparatus and methods for protecting electrodes against vibration, shock and other damaging forces.

BACKGROUND OF THE DISCLOSURE

Some manual welding systems use consumable electrodes that are commonly referred to as rods or sticks. The electrodes may have special coatings that can be easily chipped or damaged by impact forces. For example, during transportation the coatings may be damaged by rough handling or rattling. Sometimes these expensive electrodes may be damaged to the point of having to be scrapped.

SUMMARY OF THE DISCLOSURE

In accordance with an embodiment of one of the inventions presented in this disclosure, a packaging arrangement for electrodes includes a container that holds a plurality of the electrodes, and an insert for the container that has a first section that generally conforms to an internal shape of the container and a second section that generally conforms to a bundled shape of the electrodes. In a more specific embodiment, the insert comprises a single web of material with one or more slits that allow the first section and the second section to be formed into conforming shapes as needed.

In accordance with another embodiment of one of the inventions presented herein, a packaging arrangement for electrodes includes a container that holds a plurality of the electrodes, an insert for the container that has a first section that generally conforms to an internal shape of the container and a second section that generally conforms to a bundled shape of the electrodes, and a binding that applies tension about the insert second section. In a more specific embodiment, the binding may be realized in the form of a web of material around the insert second section and that provides residual tension that keeps the rods bundled together.

In accordance with another embodiment of one of the inventions presented herein, a method for packaging electrodes includes the steps of forming an insert with a first section and a second section, bending the first section about a longitudinal axis of a container and sliding the first section into an open end of the container with the first section generally conforming to an internal shape of the container, inserting a plurality of electrodes into the container with end portions of the electrodes protruding out of the open end of the container, and bending the second section about the longitudinal axis of the container to generally conform to a bundled shape of the end portions of the electrodes. In another embodiment, the method includes binding the second section and the end portions of the electrodes together.

These and other aspects, embodiments and advantages of the inventions disclosed herein will be understood by those skilled in the art from the following detailed description of the exemplary embodiments in view of the accompanying drawings.

DESCRIPTION OF THE EXEMPLARY EMBODIMENTS

Figure 1:
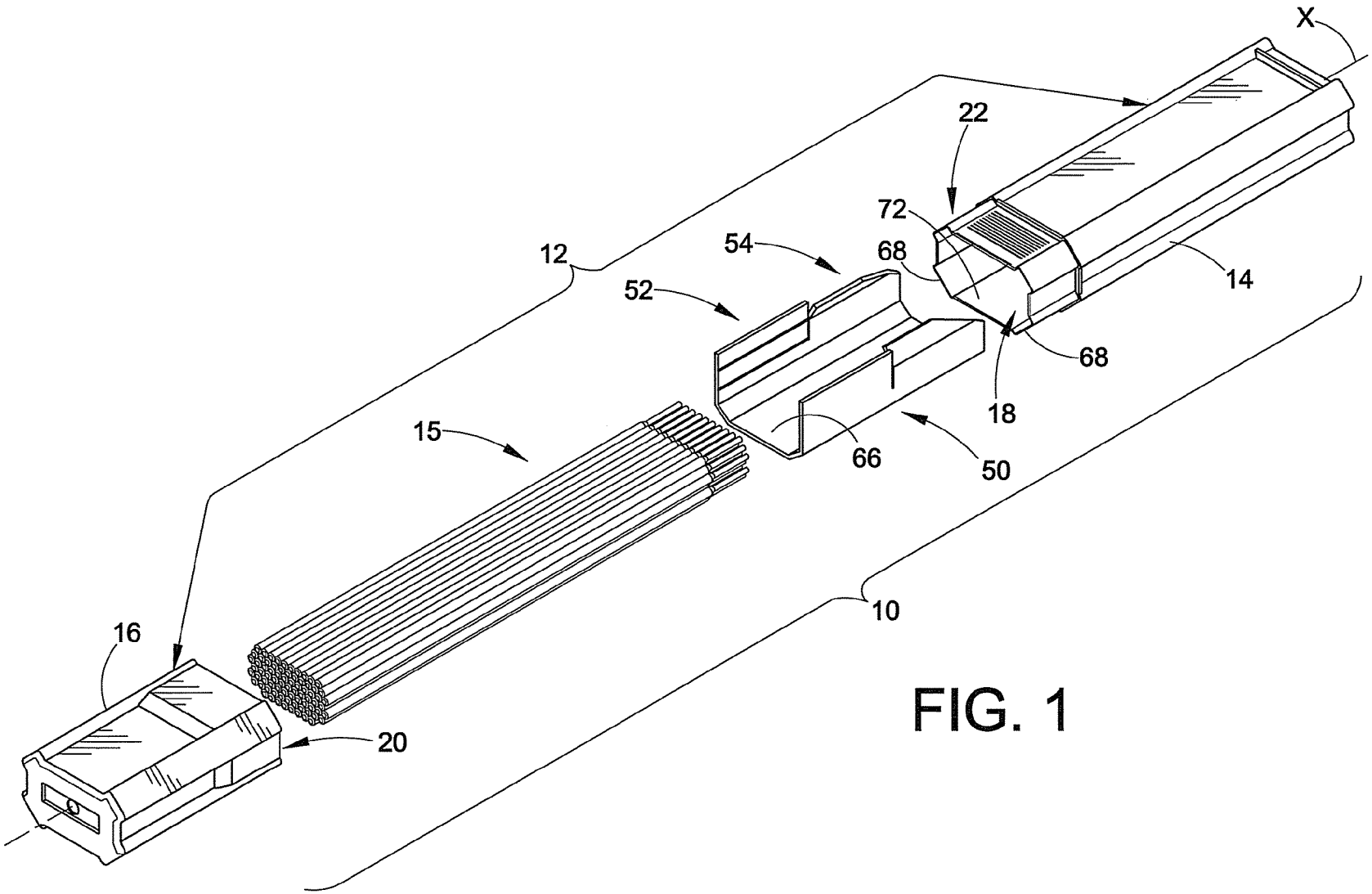
FIG. 1 is an embodiment of a packaging arrangement for welding electrodes, illustrated in exploded perspective.

While the various inventions are described herein with reference to specific embodiments, such illustrations and descriptions are intended to be exemplary in nature and not as the only embodiments. For example, an embodiment of a container for electrodes is illustrated with a particular configuration, shape and functionality, however, the present inventions may be used with many different types, sizes and shapes of containers and electrodes. The exemplary electrodes illustrated herein are generally round elongated rods, such as about 3/16 in. diameter and about fourteen inches length, but the actual dimensions may vary from application to application. A typical bundle of such electrodes weighs five or ten pounds, comprising about sixty or so rods, but the actual number will depend on the rod dimensions.

It is important to note that the term "conform" as used herein is meant to be interpreted in its more general sense of two shapes that have similar but not necessarily identical shapes. For example, an insert as described herein is characterized as "conforming" to an internal shape of a container, which means that the insert may have a similar if not identical shape, outline or contour to a portion of the internal shape, outline or contour of the container.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—-such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

With reference to FIG. 1, an embodiment of one or more of the inventions herein of a packaging arrangement 10 for manual welding electrodes is illustrated. The packaging arrangement 10 may include a two piece container 12 including a bottom tube 14 and a complementary top tube 16, such that when the top and bottom tubes are slid together they form an enclosure for the electrodes. The bottom tube 14 has an open end 18 that receives the major length of a plurality of electrodes 15 (not shown in FIG. 1, see FIG. 6), and the top tube 16 has an open end 20 that slides over any exposed ends of the electrodes 15 and onto a reduced end portion 22 of the bottom tube 14. The top tube 16 slides onto the bottom tube 14 in a telescoping manner along the longitudinal axis X to close the container 12 with the electrodes 15 therein and may have a snap fit or interlock when fully assembled. The two piece container 12 is fully described in pending U.S. patent application Ser. No. 11/931,899 filed on Oct. 31, 2007 for STACKABLE CONTAINER, published as U.S. Patent Application Publication No. 2009/0108008 on Apr. 30, 2009, commonly owned by the assignee of the present application, the entire disclosure of which is fully incorporated herein by reference. While the illustrated container 12 is suitable for use with the present inventions, it is but one of many different types of containers that may be used, and a complete understanding of the design and function of the container 12 is not needed to practice the present inventions. The incorporated patent application is only provided for further elaboration of the exemplary container herein should such description be of interest.

The electrodes 15 commonly are in the shape of rods or sticks with a generally rounded profile as is well known in the art of manual welding. The terms electrodes, rods and sticks are thus used interchangeably herein. A bundle of electrodes simply refers to a plurality of electrodes that are stacked up in parallel fashion to fit inside a tube like container (see for example, FIG. 6 herein).

The packaging arrangement 10 in accordance with this embodiment further includes an insert 50. The insert 50 is shown in FIG. 1 in an already partially formed configuration, as will be more clear from further discussion below. The insert 50 has a number of functions, one of which is to act as a pad or cushion for electrodes 15 that will be held in the container 12. While itself providing a padding function for helping to protect the electrodes 15, the insert 50 also functions as a support for the electrodes 15 in that a portion 52 of the insert 50 wraps about an end portion of the electrode bundle to assist in holding the bundle together. Another portion 54 of the insert 50 slip fits into the bottom tube 14 of the container 12 to provide additional support of the electrode bundle, as will be further described below.

The insert 50 may be made of any suitable material that pads the electrode bundle, but at the same time is both strong enough to provide support for the electrode bundle within the container to reduce rattling and loose jarring of the electrodes 15, yet also flexible enough to be formed into various generally conforming shapes of the container 12 and the electrode bundle. A preferred but not required material for the insert 50 is thin corrugated board, however other forms of paperboard may be used as needed. Corrugated board can be easily worked with to bend and fold the insert 50 into desired configurations. Another suitable material would be flexible plastics such as, for example, low density polyethylene sheet stock or polypropylene foam sheets.

Figure 2:
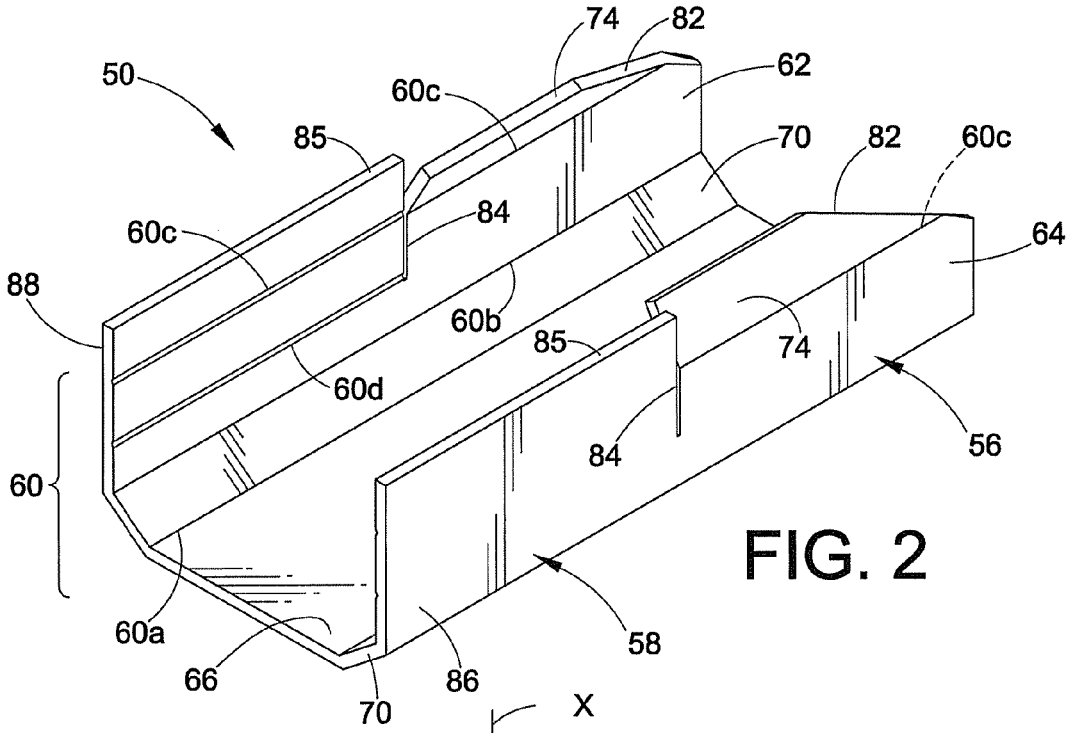
FIG. 2 is an enlarged view of an insert used in the packaging arrangement of FIG. 1, shown in a pre-formed configuration prior to insertion into a container.
Figure 7:
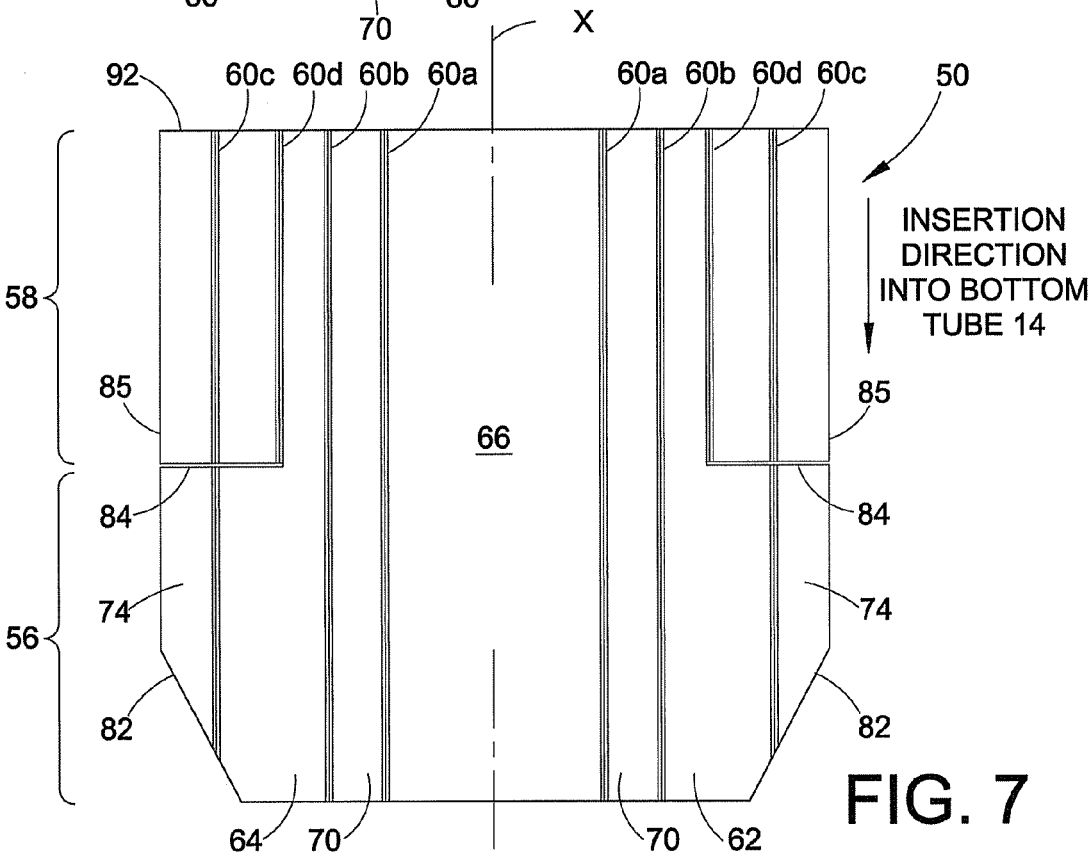
FIG. 7 is an embodiment of the insert of FIG. 2 shown in a configuration prior to forming the insert into the shape of FIG. 2.

FIGS. 2 and 7 illustrate the insert 50 in greater detail. The insert 50 in FIG. 2 is in a partially configured condition prior to final assembly of the container 12, having been formed from a flat sheet as illustrated in FIG. 7. The insert 50 in one embodiment starts out as a flat sheet of material such as corrugated board (see FIG. 7). The configuration of FIG. 2 is the arrangement of the insert 50 preparatory to inserting one end of the insert into the open end 18 of the bottom tube 14. The insert 50 preferably but not necessarily is formed from a one piece generally flat sheet of material and then may be bent and folded as needed to the desired configuration. Alternatively, the insert may be partially formed with a molding process, particularly for plastic materials.

The insert 50 may include a first section 56 and a second section 58. The first section 56 is intended to slip fit into the open end 18 of the bottom tube 14 and generally conform to an internal shape of the bottom tube 14. In this way, the first section 56 will include portions that may contact interior surfaces of the bottom tube 14 in order to provide support for the electrode bundle and the insert 50 itself. In the configuration of FIG. 2, the insert 50 has been shaped into a generally U-shaped profile. The bending and folding steps may be facilitated by the use of optional score lines 60. One or more score lines 60 may be used as needed in order to facilitate the formation of the insert 50 to a desired configuration. In a preferred but optional manner, the score lines 60 may run generally perpendicular to the flutes of the corrugated material.

The first section 56 is formed into a shape that will generally conform to an internal shape of the bottom tube 14. In this embodiment, the first section 56 includes two generally parallel walls 62, 64 that extend upward from a generally flat base 66 along a first score line 60*a*. Although not numbered on FIG. 2, the score lines 60 may typically be formed in both walls 86, 88 of the second section 58, and the score line 60*c* may be formed in both walls 62, 64 of the first section (see, for example, FIG. 7). Since the container 12 has lower beveled corners 68 (see FIG. 4) the parallel walls 62 and 64 may optionally be joined to the base 66 with a respective lower bevel 70, formed between the first score line 60*a* and a second score line 60*b* that runs parallel to the first score line 60*a*. The base 66 may sit against the flat bottom wall 72 of the bottom tube 14 (FIG. 1). Alternatively, some containers may have non-flat bottom walls and the base 66 may be shaped to generally conform thereto as needed.

Figure 4:
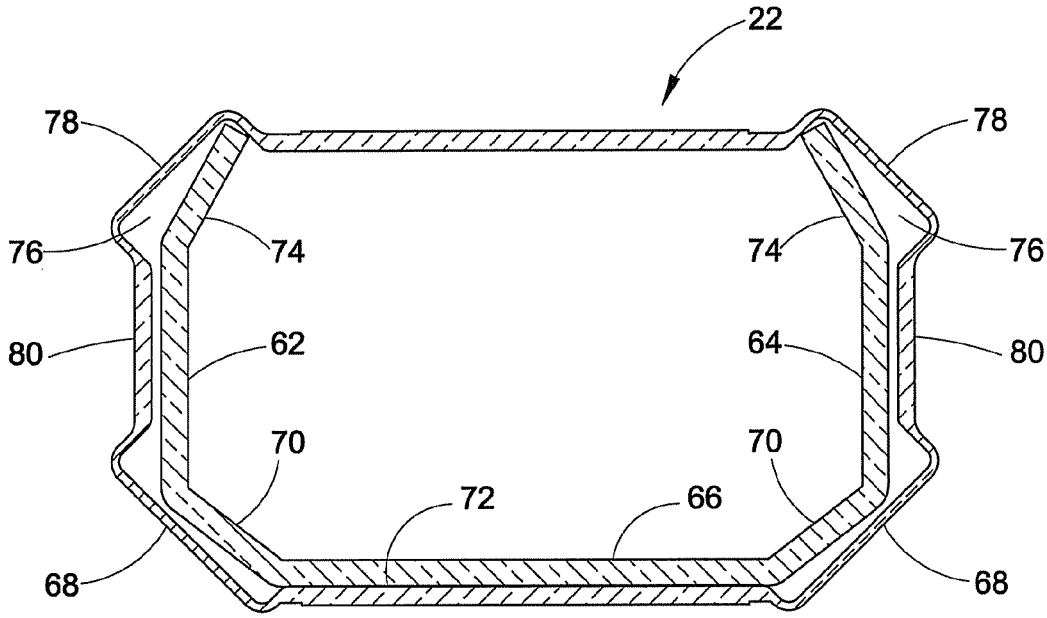
FIG. 4 is a cross-section view taken along the line 4-4 of FIG. 3.

Along the upper portion of each of the generally parallel walls 62, 64 is a wing or tab 74 that is able to be bent inward from a third score line 60*c*. These wings 74 are shaped so as to slide into internal slots 76 formed by upper beveled corners 78 of the container 12 wall structure (see FIG. 4). As best represented in FIG. 4 then, the base 66, the lower bevels 70, the walls 62, 64 and the wings 74 generally conform to an internal shape of the container 12. In this embodiment an internal shape of the container 12 may be viewed as including the internal wall structure of the bottom tube, with the internal wall structure including the bottom wall 72, the lower beveled corners 68, Vertical walls 80 and the upper beveled corners 78. The extent of how close in conformance the insert first section 56 is to the internal shape of the container bottom tube 14 is a matter of design choice. In some cases, close conformance may be desired for added strength and support, in other cases such as illustrated herein, general conformance provides excellent support and strength. For example, the insert first section 56 may but need not be in intimate surface to surface contact with the container interior surfaces. For example, the wings 74 slide into the internal slots 76 and are in contact with portions of the surfaces of the slots 76, but only portions of the wings 74 may be in direct physical contact. The walls 62, 64 may or may not directly contact the walls 80 of the container, and the lower bevels 70 may or may not make full surface contact with the lower beveled corners 68 of the container. Yet the insert 50 generally conforms to the internal contour or shape of the container bottom tube 14. This less than exact but adequate conformance is due in part to the flexible nature of the insert material and the simple way that that insert 50 can be formed and shaped by bending and folding. But the insert 50 still has sufficient strength and rigidity to support an electrode bundle in the container. To this end, for example, the flutes of the corrugated board preferably though not necessarily run parallel to the surfaces of the internal shape of the container. The insert first section then provides a rigid and strong support of the insert 50 itself and the electrode bundle to prevent rattling and movement of the electrode bundle in the container 12.

Each wing 74 may optionally be provided with tapered end portions 82 which facilitate inserting the first section 56 into the open end 18 of the bottom tube 14.

The insert 50 also may have a second section 58, and this section may be used to envelop end portions of the electrode bundle. To this end, the second section 58 may in many cases take on a different configuration than the first section 56. In order to facilitate these differences while still using a single piece sheet of material for the insert 50, a pair of slits or slots 84 may be provided in each of the vertical wall portions of the U-shaped insert 50. Preferably though not required, the slits 84 begin on a peripheral edge 85 of the insert 50 and extend generally transverse the peripheral edge into the main body of the insert 50. The slits 84 allow portions of the first section 56 to be bent and folded into a different configuration than portions of the second section 58. Thus in the exemplary embodiment, the first section 56 may be shaped to generally conform to the internal shape of the container bottom tube 14, while the second section 58 may be shaped to generally conform to the bundled shape of the electrodes 15.

Figure 5:
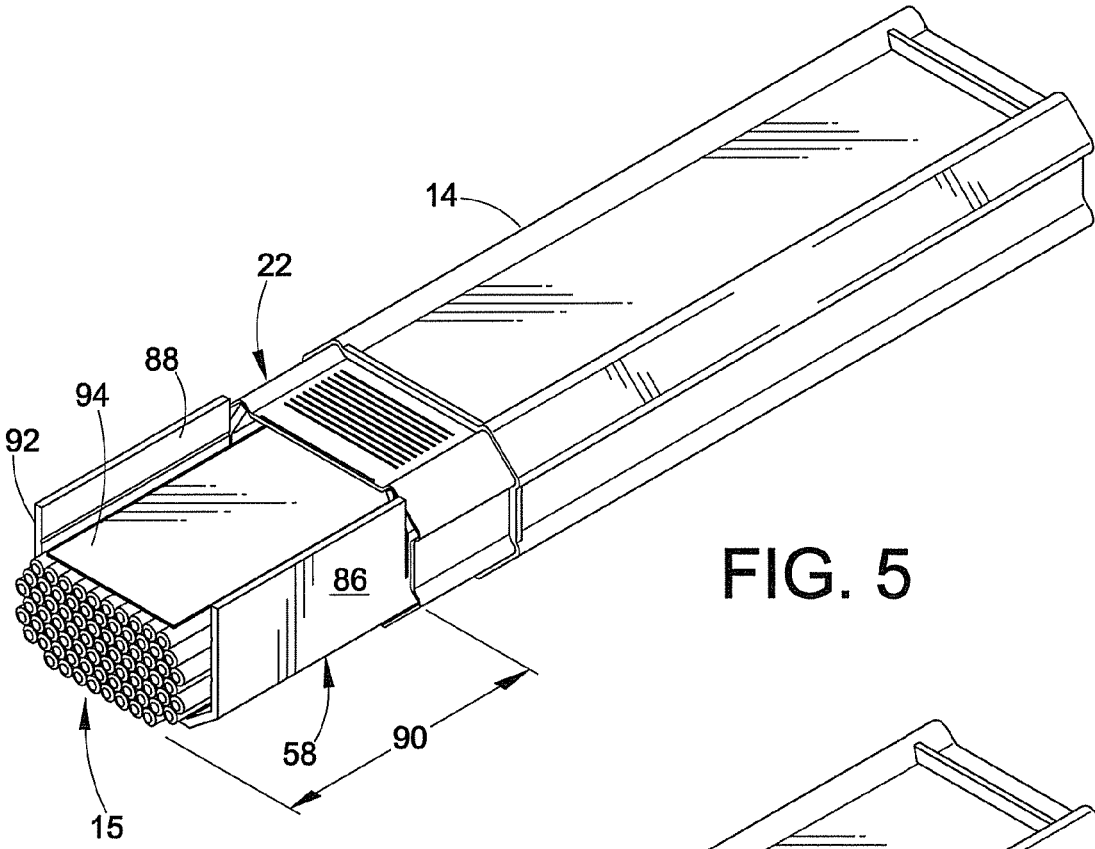
FIG. 5 illustrates in perspective the packaging arrangement of FIG. 2 with electrodes inserted prior to binding.
Figure 6:
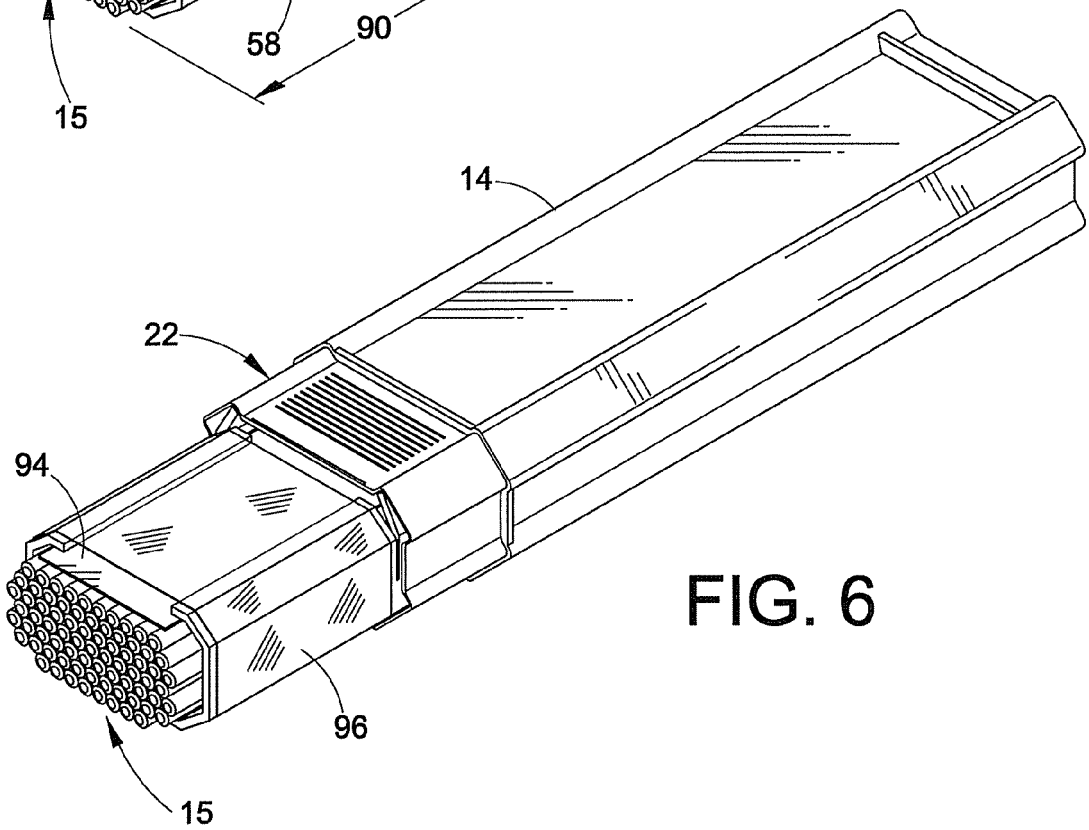
FIG. 6 illustrates in perspective the packaging arrangement of FIG. 5 after binding.

With typically rounded electrode rods, an electrode bundle such as represented in FIG. 6 may have a somewhat rounded profile along the sides between generally flat top and bottom portions (flat because in this example the container bottom wall is flat). Accordingly, in this embodiment the second section 58 preferably will be wrapped about the bundle of electrodes. To this end, the second section 58 may be formed with generally parallel walls 86, 88 that can be bent about an electrode bundle and have a generally rounded conforming shape, as illustrated in FIG. 5. Still referring to FIG. 2 as well, the second section 58 thus may include an additional score line 60*d* that is formed up to the location of the slits 84. This additional score line allows the walls 86, 88 to be formed with a more rounded profile to closely envelop the electrode bundle. Note in this embodiment that the third score line 60*c* may continue across both sections 56, 58, separated by the slits 84. The depth of the slits 84 may be selected as needed to facilitate forming the configurations needed for the first section 56 and the second section 58. Further note that the insert second section 58 need not fully envelop all the electrodes, but rather should envelop enough of the bundle to securely hold the bundle together against shock and rattling or other forces.

Figure 3:
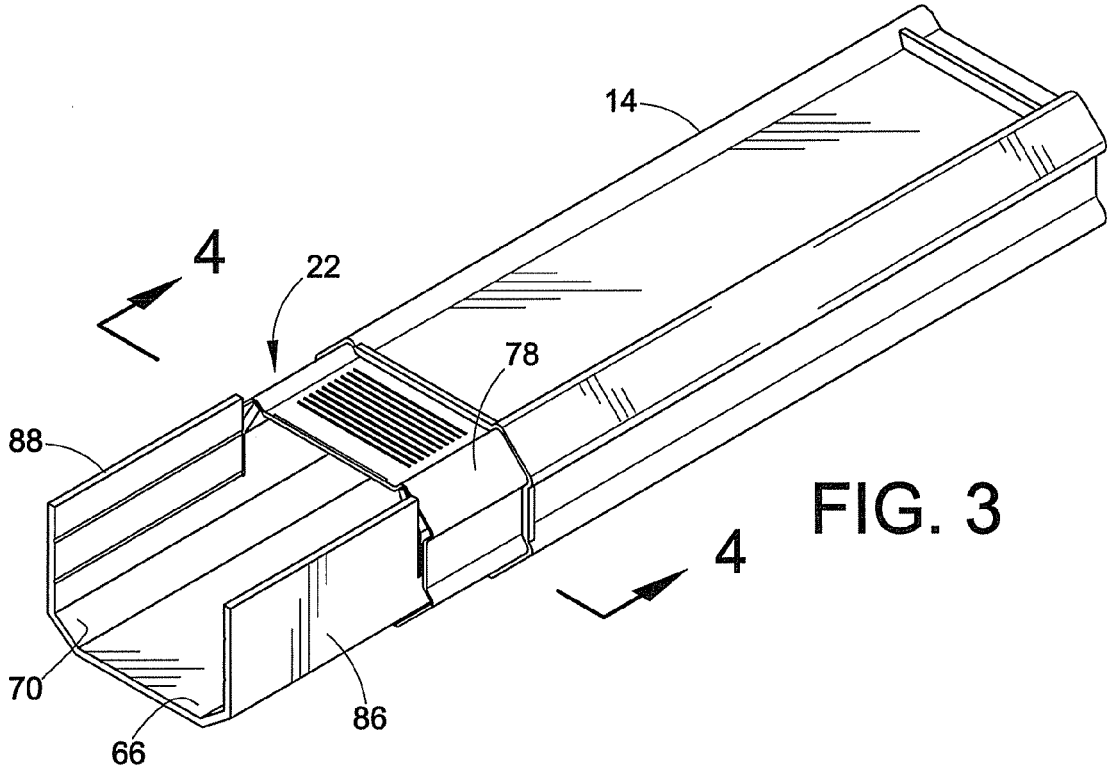
FIG. 3 illustrates in perspective the insert of FIG. 2 inserted into the bottom tube of the container, in perspective.

Referring to FIG. 3, the insert 50 is illustrated having been slid into the bottom tube 14. Because the second section 58 still has the walls 86, 88 in an upright pre-bent position, the insert 50 slides into the bottom tube 14 up to the axial position of the slits 84, at which point the upright walls 86, 88 contact the bottom tube 14 wall structure and resist further insertion. This is the position illustrated in FIG. 3. In this configuration, the protruding second section 58 may be used as a scoop to assist in loading the electrodes 15 into the bottom tube 14.

With reference next to FIG. 5, the assembly is illustrated after the electrodes 15 have been slid into the bottom tube 14. In this exemplary embodiment, the bottom tube 14 is of such a length as to receive the major portion of the electrode length, with an end portion 90 of each electrode 15 protruding from the bottom tube 14. Preferably although not necessarily, the length of the second section 58 of the insert 50 is selected such that with the electrodes 15 fully bottomed in the bottom tube 14, the end portions 90 extend slightly beyond an outer end 92 of the insert 50.

Also illustrated in FIG. 5 is the option to include printed material or other types of inserts 94 (for example, warning sheets, material safety data sheets, instruction sheets, and so on) that are positioned on top of the electrode bundle.

With reference to FIG. 6, and in accordance with an aspect of another inventive feature, after any optional labeling, literature or other inserts 94 have been positioned on top of the end portions 90 of the electrodes, a binding 96 may be applied to the electrode bundle and the insert second section 58 so as to form a tightly held bundle that is also well anchored against rattling, shaking and other potentially harmful movement of the electrodes within the container 12. In an exemplary embodiment, the binding 96 may comprise a clear stretch wrap type material, such as, for example, WEST #032590 which is a high performance stretch banding wrap of metallocene-enhanced film featuring a two-sided cling treatment (in one example, about three inch wide by 2500 feet on a roll and 90 gauge or 0.0090 thickness). The stretch wrap material may be installed manually or with a machine. The binding 96 is wrapped and stretched about the end portions 90 of the electrodes, as well as the second section 58 of the insert 50. This causes the walls 86, 88 to be formed around the electrode bundle. By appropriate location of the score lines 60*a*-60*d*, the second section of the insert 50 will wrap about the end portions of the electrodes and generally conform to the bundled shape, as depicted in FIG. 6. The binding 96 may but need not extend over the entire length of the second section 58, but the axial length of the binding 96 should be sufficient to assure a tightly held bundle. The binding 96 also securely holds the optional labeling or literature or other inserts 94 in place.

A desired feature of the selected material for the binding 96 is to use a binding that will maintain a residual tension against the insert second section 58 and the electrode bundle. During normal use, handling and transportation, the electrode bundle will tend to settle due to shifting and shaking of the bundle. By using a binding that maintains tension on the bundle, a tightly held structure will be maintained to significantly reduce the chance of damage to the electrodes. Many different shrink wrap type materials may be used and will maintain the residual tension over extended periods of time. Alternatively, other materials may be used, for example rubber banding. In general, any stretchable material that will lay flat enough to fit within the top tube 16 along with the insert 50 and the electrode bundle may be used, with preferably the stretchable material retaining its elastic nature and thus residual tension to hold the bundle in place. The binding 96 thus serves as means for applying tension about the insert second section to tightly bundle the electrodes together.

In addition to the binding providing a tightly held bundle within the second section 58 of the insert 50, because of the unitary structure of the first and second sections 56, 58, the bundled electrodes are firmly supported within the container 12 against rattling, shaking and other impact forces that could damage the electrode ends. The first section 56 of the insert is firmly supported inside the bottom tube 14 of the container 12, as described herein above. With the binding 96 functioning to securely hold the electrodes with the insert 50, the combination of the binding 96 and the insert 50 being disposed about the electrode bundle 15 with residual tension provides a strong stable structure firmly secured within the container 12. Should a different container structure be used, it is a straight forward modification to change the insert 50 design so that a portion of the insert 50 generally conforms to an internal shape of the container while another portion of the insert 50 generally conforms to the bundled shape of the electrodes. After the binding 96 is installed, the top tube 16 easily slides over the bundled electrode ends and can be joined to the bottom tube 14 to complete the container 12 assembly.

FIG. 7 illustrates an embodiment of a flat sheet of corrugated board or other chosen material to form the insert 50. An example sheet stock is a piece of corrugated board about 105 mils (0.105 inch) thick with the flutes running generally transverse the X axis. The insert 50 may be manually formed to the initial shape such as illustrated in FIG. 2 herein. For other materials such as plastics for example, the insert 50 may be initially also a flat sheet and manually formed as needed, or molded to an initial shape. The number, length and location of the various score lines 60 may be selected based on the internal shape of the container 12 and the overall size and shape of the bundled electrodes.

An embodiment of an exemplary method for packaging electrodes may include the steps of forming an insert with a first section and a second section. This step may include forming a flat sheet of shapeable material, an example of which is corrugated board or sheet plastic with appropriate score lines. Next, a first section is bent or folded as needed about a longitudinal axis of a container and the first section is slid into an open end of the container with the first section generally conforming to an internal shape of the container. Next a plurality of electrodes may be slid into the container with end portions of the electrodes protruding out of the open end of the container. The second section may be formed about the longitudinal axis of the container to generally conform to a bundled shape of the end portions of the electrodes, with a binding applied to hold the second section and the end portions of the electrodes together with residual tension. These method steps need not be implemented in this precise order.

The inventive aspects have been described with reference to the exemplary embodiments. Modification and alterations will occur to others upon a reading and understanding of this specification. It is intended to include all such modifications and alterations insofar as they come within the scope of the appended claims or the equivalents thereof.

I claim:

1. In combination, a plurality of electrode rods and a package for retaining the electrode rods, the package comprising:

a container comprising first and second end pieces that join together to form an enclosure in which the plurality of electrode rods is received; and an insert comprising a first section extending into the first end piece and generally conforming to an internal shape of the first end piece, and a second section that generally conforms to a bundled shape of the plurality of rods, the internal shape of the first end piece being different from the bundled shape.

2. Package for welding electrodes, comprising:

a container for holding a plurality of electrodes; the container comprising first and second end pieces that join together to form an enclosure; at least one of the first and second end pieces having a non-rectangular internal shape;

an insert for the container, the insert comprising a first section that fits into the first end piece and generally conforms to an internal shape of the first end piece, and a second section that generally conforms to a bundled shape of a plurality of the electrodes; the internal shape of the first end piece being different from the bundled shape; and means for applying tension about the insert second section to tightly bundle the electrodes together.

3. Package for electrode rods, comprising:

a container for holding a plurality of rods; the container comprising first and second end pieces that join together to form an enclosure;

a single piece insert for the container, the insert comprising a first section that fits into the first end piece and generally conforms to an internal shape of the first end piece, and a second section that generally conforms to a bundled shape of a plurality of the rods; the internal shape of the first end piece being different from the bundled shape;

a binding that applies tension about the insert second section.

4. The combination of claim 1, wherein the package further comprises a binding that applies tension about the insert second section.

5. The combination of claim 1 wherein the insert first section engages an internal surface of the first end piece to provide a rigid support of the plurality of rods within the container.

6. The package of claim 2, wherein the means for applying tension about the insert second section comprises a binding wrapped around the insert second section.

7. The package of claim 2 wherein the insert comprises a body having one or more transverse slits separating the first section from the second section to allow the first section to conform to the internal shape of the first end piece and the second section to conform to the bundled shape of the rods.

8. The package of claim 2 wherein the insert first section comprises bendable wings that slide into internal slots in the first end piece, such that the wings are retained in a container engaging condition.

9. The package of claim 3 wherein the insert comprises a body having one or more transverse slits separating the first section from the second section to allow the first section to conform to the internal shape of the first end piece and the second section to conform to the bundled shape of the rods.

10. The package of claim 3 wherein the insert first section comprises bendable wings that slide into internal slots in the first end piece, such that the wings are retained in a container engaging condition.

11. The combination of claim 4 wherein the binding comprises a web of material around the insert second section and that has residual tension that keeps the rods bundled together.

12. The combination of claim 11 wherein the binding comprises stretch wrap material.

13. The combination of claim 1 wherein the insert comprises paper board or plastic.

14. The combination of claim 13 wherein the insert comprises corrugated paper board.

15. The combination of claim 1 wherein the insert comprises a body having one or more transverse slits separating the first section from the second section that allow the first section to conform to the internal shape of the first end piece and the second section to conform to the bundled shape of the rods.

16. The combination of claim 1 wherein the insert first section comprises bendable wings that slide into internal slots in the first end piece, such that the wings are retained in a container engaging condition.

17. The combination of claim 1 wherein the insert second section at least partially surrounds end portions of the rods in a tightly packed bundle held together by tension of the binding.

18. The combination of claim 1 wherein the insert first and second sections comprise longitudinal scores that facilitate formation of the insert to conforming shapes.

19. The combination of claim 4 comprising a label held in place between the binding and the rods.

* * * * *